US007528370B2

(12) United States Patent
Schwartz

(10) Patent No.: US 7,528,370 B2
(45) Date of Patent: May 5, 2009

(54) HIGH-Q PULSED FRAGMENTATION IN ION TRAPS

(75) Inventor: Jae C. Schwartz, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 272 days.

(21) Appl. No.: 11/662,693

(22) PCT Filed: Sep. 12, 2005

(86) PCT No.: PCT/US2005/032762

§ 371 (c)(1),
(2), (4) Date: Mar. 13, 2007

(87) PCT Pub. No.: WO2006/031896

PCT Pub. Date: Mar. 23, 2006

(65) Prior Publication Data

US 2007/0295903 A1 Dec. 27, 2007

(51) Int. Cl.
*H01J 49/42* (2006.01)

(52) U.S. Cl. ..... 250/292; 250/290

(58) Field of Classification Search ..... 250/292, 250/290, 281, 282

See application file for complete search history.

(56) References Cited

U.S. PATENT DOCUMENTS 4,736,101 A 4/1988 Syka et al.
4,959,543 A 9/1990 McIver et al.
5,075,547 A 12/1991 Johnson et al.
5,128,542 A 7/1992 Yates et al.
5,200,613 A 4/1993 Kelley
5,206,509 A 4/1993 McLuckey et al.
5,274,233 A 12/1993 Kelley
5,298,746 A 3/1994 Franzen et al.
5,302,826 A 4/1994 Wells
5,352,890 A 10/1994 Johnson et al.
5,381,006 A 1/1995 Wells et al.
5,381,007 A 1/1995 Kelley
5,404,011 A 4/1995 Wells et al.
5,436,445 A 7/1995 Kelley et al.
5,508,516 A 4/1996 Kelley (Continued)

OTHER PUBLICATIONS

James W. Hager, "Product ion spectral simplification using time-delayed fragment ion capture with tandem linear ion traps", *Rapid Commun. Mass Spectrom.*, 2003; 17: 1389-1398.

(Continued)

*Primary Examiner*—Kiet T Nguyen
(74) *Attorney, Agent, or Firm*—Charles B. Katz

(57) ABSTRACT

An ion trap (104) for a mass spectrometer includes an RF trapping voltage source (112) for applying an RF trapping voltage to at least one of a plurality of electrodes (102, 106, 110) of the ion trap (104) to trap at least a portion of ions in the ion trap (104); a resonance excitation voltage source (114) for applying a resonance excitation voltage pulse to the electrodes(102, 106, 110) to cause at least a portion of a selected set of ions to undergo collisions and break into ion fragments; and a computer (116) for controlling the RF trapping voltage source (112) to reduce the RF trapping voltage after a predetermined delay period following termination of the resonance excitation voltage pulse to a second amplitude for retaining a low mass ion fragments in the ion trap (104) for later analysis.

17 Claims, 5 Drawing Sheets

U.S. PATENT DOCUMENTS

| | | | | |
|---|---|---|---|---|
| 5,528,031 | A | 6/1996 | Franzen | |
| 5,561,291 | A | 10/1996 | Kelley et al. | |
| 5,572,022 | A | 11/1996 | Schwartz et al. | |
| 5,610,397 | A | 3/1997 | Kelley | |
| 5,679,951 | A | 10/1997 | Kelley et al. | |
| 5,864,136 | A | 1/1999 | Kelley et al. | |
| 6,147,348 | A | 11/2000 | Quarmby et al. | |
| 6,410,913 | B1 | 6/2002 | Brekenfeld et al. | |
| 6,710,336 | B2 | 3/2004 | Wells | |
| 6,770,872 | B2 | 8/2004 | Bateman et al. | |
| 6,900,430 | B2 | 5/2005 | Okumura et al. | |
| 6,949,743 | B1 | 9/2005 | Schwartz | |
| 6,965,106 | B2 * | 11/2005 | Ding et al. | 250/292 |
| 7,157,698 | B2 * | 1/2007 | Makarov et al. | 250/281 |
| 2004/0021070 | A1 | 2/2004 | Bateman et al. | |
| 2004/0021072 | A1 | 2/2004 | Soudakov et al. | |
| 2004/0079873 | A1 | 4/2004 | Bateman et al. | |
| 2004/0079874 | A1 | 4/2004 | Bateman et al. | |

OTHER PUBLICATIONS

Reid et al, "Time Delayed Fragmentation Using a Hybrid RF/DC Quadrupole-Linear Ion Trap Mass Spectrometer", *Proceedings of the 50th ASMS Conference on Mass Spectrometry and Allied Topics*, Orlando, Florida; 2002.

Murrell et al, ""Fast Excitation" CID in a Quadrupole Ion Trap Mass Spectrometer," J. Am Soc Mass Spectrom, Elsevier Inc., p. 785-789, (Jun. 2, 2003).

* cited by examiner

HIGH-Q PULSED FRAGMENTATION IN ION TRAPS

CROSS-REFERENCE TO RELATED APPLICATIONS

This application is a National Stage application under 35 U.S.C. §371 of PCT Application No. PCT/US2005/032762, filed Sep. 12, 2005, entitled "High-Q Pulsed Fragmentation In Ion Traps", which claims the priority benefit of U.S. application Ser. No. 11/210,555, filed Aug. 23, 2005, entitled "High-Q Pulsed Fragmentation In Ion Traps", which is a continuation-in-part of U.S. application Ser. No. 10/941,653, filed on Sep. 14, 2004, entitled "High-Q Pulsed Fragmentation In Ion Traps", which applications are incorporated herein by reference in their entireties.

BACKGROUND OF THE INVENTION

1. Field of the Invention

The present invention relates generally to mass spectrometry, and more specifically to the use of ion traps for multistage (MS/MS) mass spectrometry.

2. Description of the Related Art

One of the strengths of ion traps is their ability to be used for multiple stages of mass analysis, which is commonly referred to as MS/MS or $MS^n$. MS/MS typically involves fragmentation of an ion or ions of interest in order to obtain detailed information regarding the ion's structure. When performing MS/MS in an ion trap, there are various ways to activate ions in order to get them to fragment. The most efficient and widely used method involves a resonance excitation process. This method utilizes an auxiliary alternating current voltage (AC) to be applied to the ion trap in addition to the main trapping voltage. This auxiliary voltage typically has a relatively low amplitude (on the order of 1 Volt (V)) and a duration on the order of tens of milliseconds. The frequency of this auxiliary voltage is chosen to match an ion's frequency of motion, which in turn is determined by the main trapping field amplitude and the ion's mass-to-charge ratio (m/z).

As a consequence of the ion's motion being in resonance with the applied voltage, the ion takes up energy from this voltage, and its amplitude of motion grows. In an ideal quadrupole field, the ion's amplitude will grow linearly with time if the resonance voltage is continuously applied. The ion's kinetic energy increases with the square of the ion's amplitude and therefore any collisions which occur with neutral gas molecules (or other ions) become increasingly energetic. At some point during this process, the collisions which occur deposit enough energy into the molecular bonds of the ion in order to cause those bonds to break, and the ion to fragment. If sufficient energy is not deposited into the molecular bonds while the ion's amplitude grows, the ion will simply hit the walls of the trap and be neutralized, or the ion will leave the trap through one of its apertures. Efficient MS/MS requires that this loss mechanism be minimized. Consequently, the parameters which affect the rate at which the ion's amplitude grows, and the energy of the collisions which occur, are important in determining the overall efficiency of fragmentation.

One of the most important parameters which influences both processes is the frequency at which this resonance process takes place. This frequency is dependant on the Mathieu stability parameter Q, whose value is proportional to the amplitude of the main RF trapping voltage and inversely proportional to the m/z of the ion of interest. The operational theory of quadrupole fields determines that any ions that have a Q value above 0.908 have unstable trajectories in the ion trap and are lost (either by ejection from the trap or by impinging on a surface.) Consequently, at any given RF amplitude, there is a value of m/z below which ions are not trapped. This value of m/z is called the low mass cut-off (LMCO). Proper selection of the RF trapping voltage amplitude to be applied during the activation process therefore involves consideration of two important parameters that depend on the RF trapping voltage amplitude: first, the frequency of the ion's motion, which in turn determines the kinetic energy of the collisions, and; second, the LMCO.

Due to requiring some minimum ion frequency for fragmentation, Q values of approximately 0.2 or greater are normally required to obtain acceptable fragmentation efficiencies of the parent ions. Operation at higher Q values produces more energetic collisions and therefore can produce more efficient fragmentation of the parent ion; however, raising the Q also raises the LMCO, preventing more of the lower mass fragments to be observed. Thus, a compromise Q value must be chosen which is sufficiently high to allow efficient fragmentation, but minimizes the LMCO. For example, commercially available ion trap systems set a default Q value of 0.25. Operation at Q=0.25 means that the lowest mass fragment ion observable is 28% of the parent ion m/z ((0.25/0.908) *100=28%). While the value of Q can be reduced to decrease the LMCO and allow detection of lower-mass fragments (which may be desirable, for example, in applications involving identification of peptide or protein structures), the decrease in Q comes at the possible expense of decreased fragmentation efficiencies. Similarly, the value of Q may be increased from the default value to produce more energetic collisions (which may be required, for example, to fragment large, singly-charged ions), but such an increase in the Q value will have the undesirable effect of raising the LMCO precluding the detection of lower-mass fragments.

In view of the foregoing discussion, there is a need for an ion fragmentation technique for ion traps that avoids the tradeoff between fragmentation energies and LMCO inherent in the prior art resonance excitation process. There is a further need in the art for a ion fragmentation technique which produces fragmentation in a shorter period of time relative to the prior art process.

BRIEF SUMMARY OF THE INVENTION

Embodiments of the present invention utilize a high-Q, pulsed fragmentation technique wherein the Q value of ions of interest within an ion trap is initially maintained at an elevated value to promote energetic collisions and consequent fragmentation, and then rapidly lowered to reduce the LMCO and allow observation of low-mass fragments. More specifically, a method for fragmenting ions in an ion trap involves first selecting a set of ions having a mass-to-charge ratio of interest (which may include a single mass-to-charge ratio or a range of mass-to-charge ratios.) The selected set of ions is then placed at a high first value of Q by applying a suitable radio-frequency (RF) trapping voltage to the ion trap. The first Q value will preferably be in the range of 0.6-0.85. Next, a resonance excitation voltage pulse is applied at a secular frequency of the selected set of ions, causing the ions to collide at high energy with neutral molecules and other ions present within the ion trap, which will result in the fragmentation of at least a portion of the selected ions. The resonance excitation voltage pulse will preferably have an amplitude that is significantly higher (typically by a factor of 5-20) relative to typical resonance excitation voltages used in prior art techniques.

After a period of time following termination of the resonance excitation voltage pulse (referred to herein as the "high-Q delay period"), the RF trapping voltage applied to the ion trap is reduced to lower the Q to a second value (typically around 0.1 or lower), which in turn lowers the LMCO. The resonance excitation voltage pulse and high-Q delay periods are selected such that the RF trapping voltage can be reduced sufficiently rapidly to prevent or minimize the loss of low-mass fragments, thereby allowing their subsequent detection and measurement. Typical resonance excitation voltage pulse and high-Q delay periods are around 100 microseconds (μs) and 45-100 μs, respectively.

The high-Q pulsed technique described above offers several substantial advantages over the prior art resonance excitation technique, including the ability to perform fragmentation at high Q values (thereby improving fragmentation efficiencies and/or accessing higher-energy fragmentation processes) while maintaining the effective LMCO at a value sufficiently low to permit detection of fragment ions which would otherwise be unobservable. Further, the technique of the invention allows fragmentation to be completed in a significantly shorter time period relative to the prior art techniques, thus increasing the rate at which MS/MS analyses may be performed. Other advantages of the invention will be apparent to those of ordinary skill in the art upon review of the detailed description and associated figures.

DETAILED DESCRIPTION OF THE INVENTION

Figure 1:
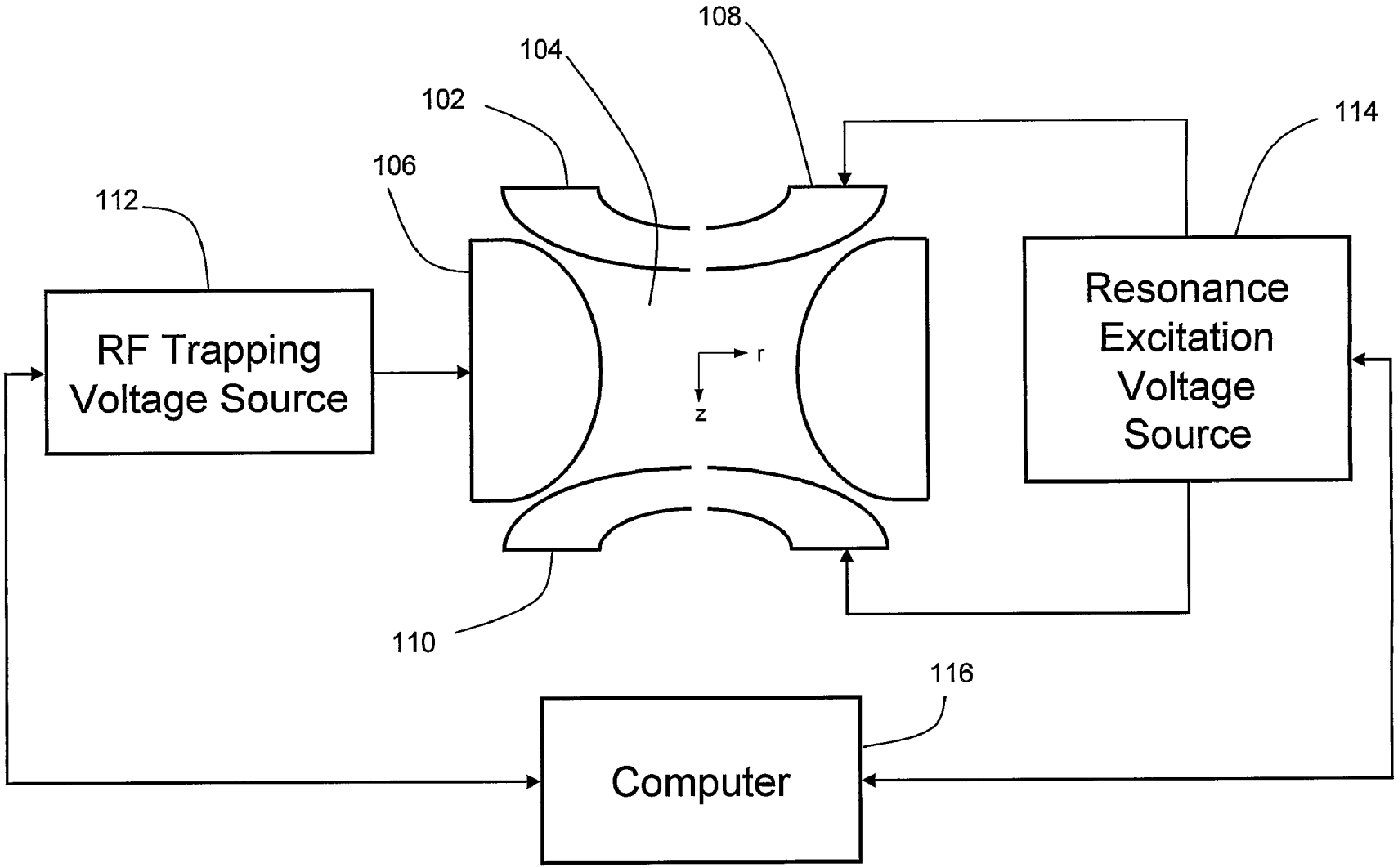
FIG. 1 is a schematic depiction of an exemplary ion trap for implementing the ion fragmentation technique of the invention.

FIG. 1 is a simplified schematic of an exemplary ion trap 102 and associated components in which embodiments of the invention may be implemented. The design of ion traps for mass spectrometry applications is well known in the art and need not be discussed in detail herein. Generally, ion trap 102 includes a set of electrodes which bound a containment region 104 in which ions are trapped by generation of an RF trapping field. Those skilled in the art will recognize that certain ion trap geometries may also require a direct current (DC) component to be included in the trapping field. In FIG. 1, ion trap 102 is depicted in the form of a conventional three-dimensional (3-D) ion trap having a ring electrode 106 and entrance and end cap electrodes 108 and 110. Apertures formed in end cap electrodes 108 and 110 and aligned across the Z-axis permit injection and expulsion of ions into and from containment region 104. An RF trapping voltage source 112 coupled to ring electrode 106 (typically via a transformer) supplies an RF-frequency waveform at an adjustable voltage amplitude. A resonance excitation voltage source 114 coupled to end cap electrodes 108 and 110 supplies a resonance excitation voltage pulse at the secular frequency(ies) of a selected ion set in the manner described below to induce activation and fragmentation of ions for subsequent analysis. The resonance excitation voltage source (or alternatively another supplemental voltage source) may also be configured to apply a supplemental waveform across end caps 108 and 110 for the purposes of isolating selected ions by resonance excitation and ejection. Both the RF trapping voltage source 112 and resonance excitation voltage source 114 are preferably placed in electrical communication with a computer 116 or other suitable processor to enable automated control and setting of operational parameters.

While embodiments of the invention are described herein with reference to a 3-D ion trap, it should be recognized that the fragmentation technique described below may also be utilized advantageously in connection with two-dimensional (2-D or linear) ion traps. Linear ion traps are known in the art and are described, for example, in U.S. Pat. No. 5,420,425 ("Ion Trap Mass Spectrometer System And Method" to Bier et al.), the disclosure of which is incorporated by reference. Generally described, linear ion traps are formed from pairs of opposed elongated electrodes aligned across orthogonal dimensions (the X- and Y-axes). Ions are contained in a region in the interior of the linear ion trap by the application of RF radial trapping voltages to electrode pairs, in combination with the generation of an axial DC field that collects ions in the medial portion of the ion trap. In linear ion traps, certain of the electrodes (e.g., the electrodes aligned with the X- or Y-axes) are adapted with apertures to allow expulsion of ions therethrough for subsequent detection. Although the technique is ideally implemented in devices with mainly quadrupole potentials, the technique described here may also have utility in any multipole device including hexapoles, octopoles, and devices with combinations of various multipole fields.

In a mass spectrometer instrument, a sample containing one or more analyte substances is ionized using any one or combination of ionization techniques known in the art, including without limitation, electron ionization (EI), chemical ionization (CI), matrix-assisted laser desorption ionization (MALDI), and electrospray ionization (ESI). Ions thus formed are guided by a suitable configuration of ion optics (which may include tube lenses, skimmers, and quadrupole and octapole lenses) through regions of successively lower pressure and are injected into containment region 104 of ion trap 102. A collision gas (also referred to as a damping or cooling gas), composed of an inert gas such as helium or nitrogen, is introduced into the containment region and maintained at a specified pressure. As will be discussed in further detail below, production of fragment ions is accomplished by resonating selected ions in ion trap 102 such that they collide at high velocity with collision gas atoms. A portion of the ions' translational energy is thereby transferred into excited vibrational modes to create an activated ion, which in turn results in breaking of molecular bonds and the dissociation of the selected ion into fragments.

Figure 2:
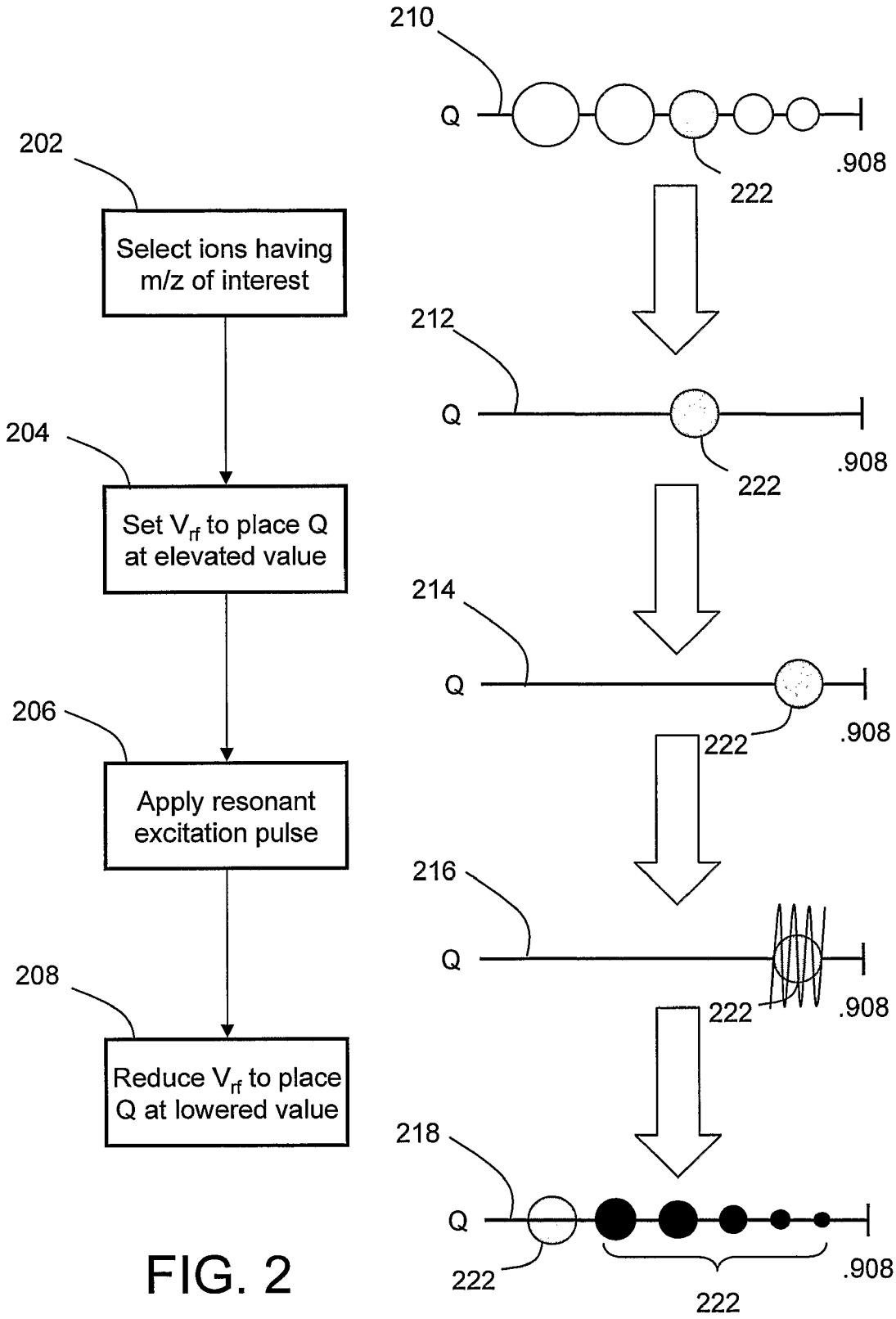
FIG. 2 is a process flowchart depicting the steps of a method for fragmenting ions in an ion trap, shown in conjunction with stability lines demonstrating how each step affects the values of Q of the ions of interest.

According to an embodiment of the invention, the ion fragmentation method includes steps of selecting a set of ions having a mass-to-charge ratio of interest, applying an RF voltage sufficient to place the Q of the selected ion set at a first elevated value (denoted herein as $Q_1$), applying a resonance excitation pulse, removing the resonance excitation pulse and maintaining the ions at the first elevated value for a delay period, and then reducing the RF trapping voltage to lower the Q of the selected ion to a second value (denoted herein as $Q_2$). These steps and their effects may be best understood with reference to FIG. 2, which depicts a flowchart of method steps together with the corresponding sequence of stability axes (Q axis) representing the changes in the Q value of ions of interest resulting from execution of the various steps of the fragmentation technique.

In step 202, a set of ions having a mass-to-charge ratio of interest is selected for fragmentation. The mass-to-charge ratio may be a single value or a range of values extending between lower and upper limits (including a range that encompasses all ions in ion trap 102). The selection step 202 may (but does not necessarily) include isolating the selected set of ions within trap 102 by expelling ions from the trap having mass-to-charge ratios that lie outside of the mass-to-charge ratio of interest. Isolation of the selected set of ions may be accomplished by employing any one of several resonant expulsion techniques known in the art, including (i) application of a broadband isolation waveform having frequencies corresponding to the secular frequencies, and (ii) application of an isolation waveform having a single frequency with scanning of the trapping RF voltage such that the resonance frequencies of the undesirable ions are successively matched to the frequency of the isolation waveform. The effect of selection of a set of ions with isolation is represented by stability axes 210 and 212. The first (pre-isolation) stability axis 210 depicts ions having a range of mass-to-charge ratios, including ion 222 having a mass-to charge ratio corresponding to the ratio of interest. The second stability axis shows an isolated ion 222 after the ions having out-of-range mass-to-charge ratios have been expelled.

Next, the RF trapping voltage is increased to elevate the Q value of ion 222. The value of Q may be calculated from ion and field parameters, along with the ion trap geometry parameters, by equations well known in the mass spectrometry art. For ion trap 102 depicted in FIG. 1 with no applied DC quadrupole field, Q is characterized by the following simplified relation:

$$Q = q_z = k\frac{V_{rf}}{(m/z)}$$

where $V_{rf}$ is the amplitude of the RF trapping voltage, m/z is the mass-to-charge ratio of the selected ion, and k is a constant that depends on the internal dimensions of ion trap 102 and the frequency of the RF trapping voltage. Thus, increasing the RF trapping voltage amplitude produces a proportional increase in Q.

As discussed in the introduction, raising the Q has the effect of increasing the secular frequency of ion 222, which in turn increases the kinetic energy possessed by the ion during the subsequent resonance excitation process by the square of the secular frequency. Therefore, performing the resonance excitation step at the elevated Q produces more energetic collisions between ion 222 and the collision gas atoms or molecules (or between ions), thereby facilitating fragmentation of ion 222. For a typical implementation, the target Q value of the selected ion set ($Q_1$) will lie in the range of 0.4-0.89, and more particularly in the range of 0.55-0.70. It should be recognized that while higher values of $Q_1$ will produce more energetic collisions, setting $Q_1$ at values closely approaching the instability limit of 0.908 may cause substantial numbers of the selected ions to be expelled from the ion trap. The change in the value of Q is represented in the stability line 216 in FIG. 2 by the rightward shift of ion 222.

It should be noted that the RF trapping voltage may simply be initially set at an amplitude sufficient to bring the Q to the elevated value $Q_1$, which would remove the need to increase the RF trapping voltage per step 204.

Next, in step 206, a resonance excitation pulse is applied to the appropriate ion trap electrodes, for example, end cap electrodes 108 and 110 of ion trap 102. The resonance excitation pulse is a signal containing a frequency which corresponds to a secular frequency of the selected ion set at the elevated $Q_1$. Exact correspondence between the frequency (ies) of the resonance excitation pulse and the secular frequency(ies) of the selected ion set is not necessarily required. The two frequencies need only match sufficiently closely to enable excitation of the selected ions. We note that in some specific implementations, a range of frequencies can be utilized, which may be particularly useful if the selected ion set includes ions having a range of mass-to-charge ratios, which correspond to a range of secular frequencies (noting that secular frequency depends on mass-to-charge ratio.) In such cases the resonance excitation pulse signal may be composed of a plurality of different frequencies (which may take the form of a continuous range of frequencies or plural discrete frequencies), wherein component frequencies correspond to at least one of the secular frequencies of the ion set. In one particular implementation, the resonance excitation pulse signal may be implemented as a DC or quasi-DC pulse constituting a broad range of component frequencies, at least one of which corresponds to a secular frequency of the selected ion set. Alternatively, the resonance excitation pulse signal may include only a single frequency, and the RF trapping voltage and/or the single frequency excitation itself may be scanned during the application of the resonance excitation pulse so that the secular frequencies of ions having different mass-to-charge ratios (noting that the secular frequencies depend in part on the RF trapping voltage amplitude) are successively matched to the resonance excitation pulse.

In addition to frequency, the resonance excitation pulse signal is characterized by the parameters of pulse amplitude and pulse duration (referred to herein as $t_{pulse}$). Optimization of these parameters for a particular instrument environment and for a specific analysis will depend on other parameters and conditions, including $Q_1$, ion trap 102 configuration, the mass-to-charge ratio and molecular bond strengths of the selected ions, degree of fragmentation required, fragmentation cycle times, ion population, and collision gas pressure. A general performance consideration is that the chosen pulse amplitude and pulse duration values should be sufficiently great to yield efficient fragmentation but not so great as to cause expulsion from ion trap 102 of the selected ion set or of the ion fragments to be observed. It will be recognized that the pulse amplitude and pulse duration parameters are functionally related, in that increased excitation may be obtained by either lengthening the pulse duration or increasing the pulse amplitude, since either action results in greater ion kinetic energy. For a typical analysis, the resonance excitation pulse amplitude will be in the range of 10-20 Volts (peak-to-peak) for selected ions at m/z near 1000, and the pulse duration will be in the range of 0.25-1000 μs with a typical value of 100 μs. The pulse amplitude values can be related to the m/z of the selected ions (e.g. proportionally), i.e., pulse amplitude values will be generally higher for selected ions having relatively greater mass-to-charge ratios.

Application of the resonance excitation pulse to the ion trap electrodes generates a supplemental field having a frequency matched to a secular frequency of the selected ion set. The supplemental field causes the oscillations of the ions of the selected ion set to increase in amplitude and a corresponding increase in the ions' kinetic energy, which grows progressively larger as the pulse is applied. During this time, some fraction of the kinetic energy of any collisions with atoms of collision gas (e.g., helium atoms) or with other ions is converted to internal energy of the ions. If enough energy is deposited into an ion, fragmentation will occur at some time thereafter. The efficiency of ion fragmentation along with the type of fragmentation which occurs can vary with increasing kinetic energy. The ion fragments produced by collision induced dissociation of the selected ions will have a range of mass-to-charge ratios. Those ions having a mass-to-charge ratio below a LMCO value will develop unstable trajectories and will be expelled or otherwise lost from ion trap 102 and hence cannot be observed during a subsequent scan. As discussed in the background section, the LMCO of observable ion fragments is proportional to the Q value. If Q were to be maintained at a relatively high value, then the LMCO would have an unacceptably high value. For example, if Q is held at a value of 0.7, then the LMCO would be (0.7/0.908) *100=77% of the mass-to-charge ratio of the selected ion (i.e., the precursor ion). This undesirable result is avoided by lowering the Q before ion fragments having mass-to-charge ratios falling in the lower portion of the range are expelled, as is described below.

In step 208, the RF trapping voltage is reduced to decrease Q to a target value $Q_2$. Provided that this step is executed sufficiently rapidly, decreasing the value of Q prevents the expulsion of ion fragments having relatively low mass-to-charge ratios which would occur if Q were maintained at a high value $Q_1$ (or even at a value of Q typically employed for the prior art resonance excitation technique), thereby extending the mass-to-charge range of observable ion fragments. The target value $Q_2$ will vary according to the specific requirements of the analysis and operational and design parameters of the mass spectrometer. For certain exemplary embodiments, $Q_2$ will lie in the range of 0.015-0.2 (such as $Q_2$=0.1). In a typical implementation, $Q_2$ maybe set at around 0.05, which yields an LMCO of 5.5% of the mass-to-charge ratio of the precursor ion, thereby allowing observation of a broad range of ion fragments. The reduction of the value of Q is represented by the leftward shift of selected ion 222 on stability line 222. Ion fragments 224, which include low-mass ion fragments (those ion fragments that have a stable trajectory within ion trap 102 at the reduced value of Q, but which would develop an unstable trajectory and be eliminated from ion trap 102, either via expulsion or by striking internal trap surfaces, if Q were held at the elevated value) are positioned to the left of the instability limit.

Figure 3:
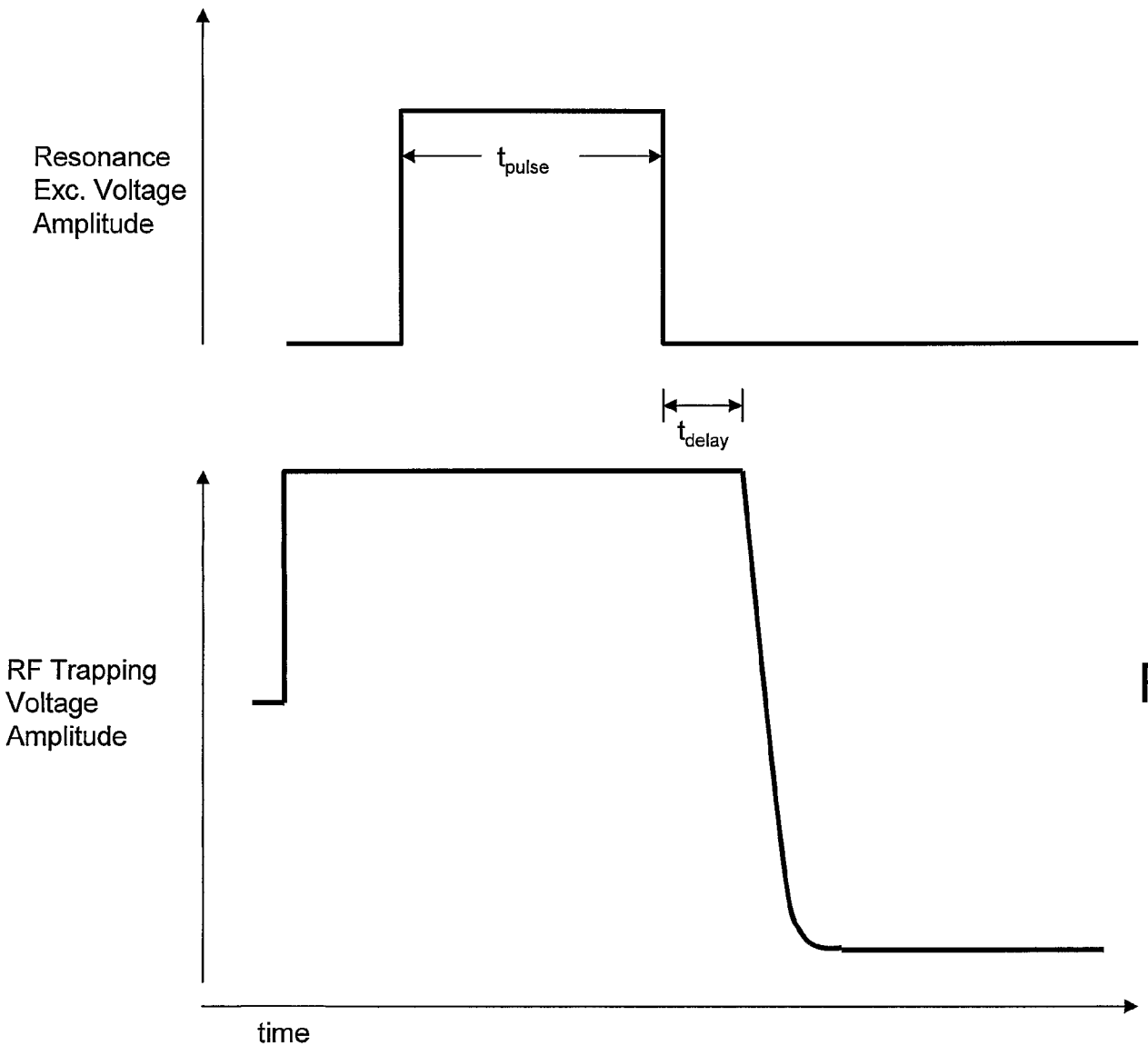
FIG. 3 is a diagram representing waveforms generated during implementation of the ion fragmentation technique.

The timing of the RF trapping voltage and supplemental excitation voltage pulses are preferably selected to provide effective fragmentation while minimizing the numbers of fragments, including low-mass fragments, eliminated from the ion trap. It is recognized that the sequential processes of ion excitation, collision-induced fragmentation, and expulsion of ion fragments require a characteristic time period, which is a function of, inter alia, resonance excitation pulse amplitude, ion trap 102 geometry and configuration, collision gas pressure, RF trapping voltage amplitude, and the mass-to-charge ratio and bond strengths of the selected ion. Referring to FIG. 3, which symbolically depicts the amplitude of the resonance excitation pulse voltage and the RF trapping voltage as a function of time, reduction of the RF trapping voltage is initiated at a time $t_{delay}$ following termination of the resonance excitation pulse, referred to herein as the high-Q delay period. In order to achieve the objective of reducing the LMCO to a desired value before a substantial portion of low-mass fragment ions are expelled from the ion trap, the two time parameters of pulse duration period ($t_{pulse}$) and high-Q delay period ($t_{delay}$) should be selected such that the aggregate time period between initiation of the resonance excitation pulse and the reduction of the value of Q is less than the characteristic time required for ion excitation, fragmentation, and expulsion of low-mass ion fragments. It should be recognized that there normally exists a time between the kinetic excitation of ions and the resultant collision-induced dissociation of ions in which the internal energy localizes in a molecular bond. In many cases ion dissociation will occur or continue to occur after the RF trapping voltage has been reduced. For a typical analysis, $t_{delay}$ will be in the range of 1-1000 μs, such as 50 μs. As is known in the art and is discernible from FIG. 3, the transition from the higher to lower RF trapping voltage is not instantaneous, but instead occurs over a non-zero transition period. This transition period should be taken into account when setting $t_{delay}$ to ensure that the Q is dropped sufficiently rapidly to avoid expulsion of ion fragments of interest. It is further noted that the aggregate time associated with the ion excitation process using the pulsed technique of the invention is considerably shorter than the time required to complete the ion excitation process by the prior art technique; the present technique typically requires less than 1 millisecond, whereas ion excitation times for the prior art technique are typically on the order of 10-30 milliseconds.

Following completion of the fragmentation process, a mass spectrum of the ions held in the ion trap (which includes ion fragments having mass-to-charge ratios below the LMCO for $Q_1$) may be obtained by using a standard mass-selective instability scan. Alternatively, one or more of the ions may be selected for further analysis (e.g., by isolating the selected ion fragments using a conventional resonance expulsion technique) and subjected to another stage of fragmentation using the technique of the invention.

Figure 4:
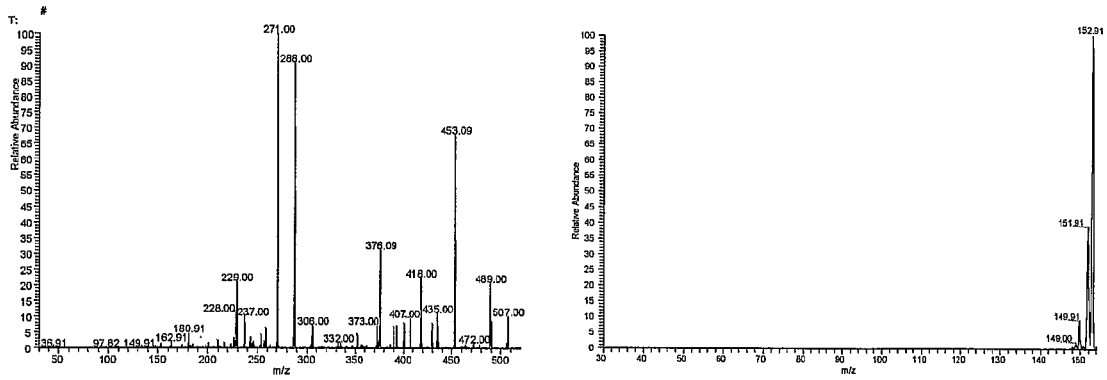
FIG. 4 is a MS/MS spectrum of the compound MRFA produced using the prior art resonance excitation technique.

The technique outlined above may be utilized for MS/MS analysis of a variety of molecules, but may be particularly useful for analysis of large biological molecules such as peptides and proteins, or for analysis of molecules having high bond strengths that make them difficult to fragment. The advantages derived from use of the high-Q, pulsed technique are demonstrated by FIGS. 4 and 5, which depict mass spectra obtained for the peptide MRFA using the prior art resonance excitation technique and the high-Q pulsed technique described above using a two dimensional linear ion trap. FIG. 4 shows the mass spectra for MRFA having m/z of 524.3 obtained by employing the prior art technique, with Q set at the typical (compromise) value of 0.25. As can be discerned in the low mass portion of the spectrum depicted on the right, no fragment ions below a mass-to-charge ratio of 144 are observed.

Figure 5:
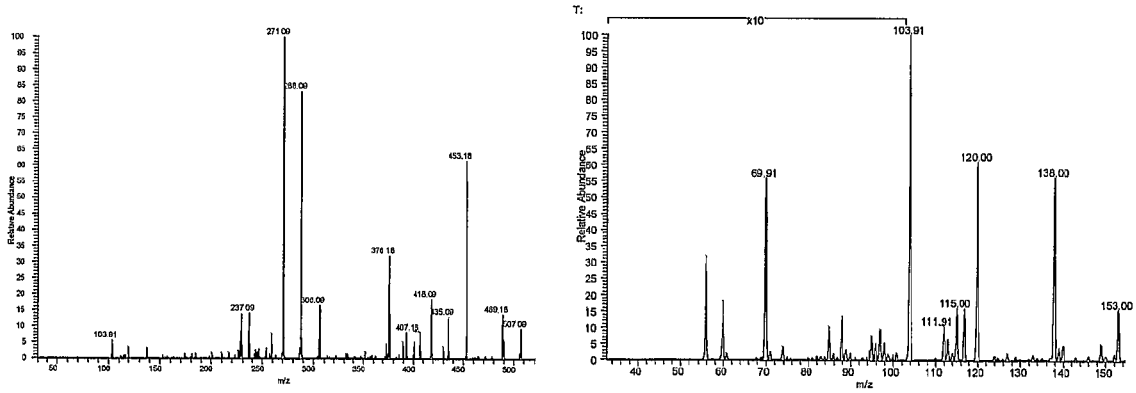
FIG. 5 is a corresponding MS/MS spectrum of the compound MRFA produced using the technique embodied in the present invention.

FIG. 5 shows results obtained using an implementation of the high-Q pulsed technique. For this analysis, the elevated and lowered RF trapping voltage amplitudes were set in order to obtain $Q_1$ and $Q_2$ values of about 0.7 and 0.05, respectively. Values for $t_{pulse}$ and $t_{delay}$ were approximately 120 μs and 50 μs. Inspection of the low mass portion of the spectrum on the right of FIG. 5 reveals that many fragment ions absent from the FIG. 4 spectrum (extending down to a mass-to-charge ratio of 56) are observed.

Figure 6:
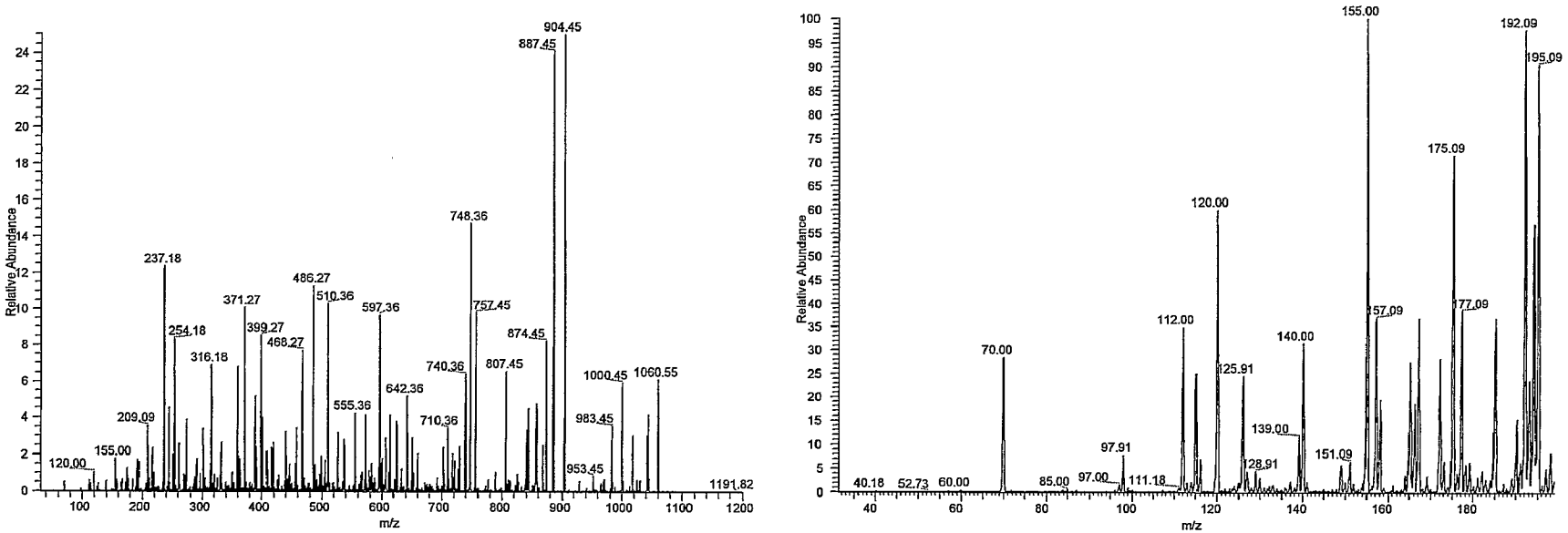
FIG. 6 is a MS/MS mass spectrum of the peptide Bradykinin at m/z 1060 produced using the technique embodied in the present invention.

FIG. 6 shows further results obtained using an implementation of the high-Q pulsed technique for higher m/z compound Bradykinin at m/z 1060. For this analysis, the elevated and lowered RF trapping voltage amplitudes were set in order to obtain $Q_1$ and $Q_2$ values of about 0.8 and 0.025, respectively. Values for $t_{pulse}$ and $t_{delay}$ were approximately 120 μs and 50 μs. Inspection of the low mass portion of the spectrum on the right of FIG. 6 reveals that significant fragment ion intensity down to m/z 70 is observed. This fragment ion has a corresponding trapping Q of 0.06 and therefore a LMCO of 6.6%, compared to values of 0.25 and 28% for the prior art resonance excitation methods.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. Apparatus for fragmenting ions in a mass spectrometer, comprising:

an ion trap having a plurality of electrodes, the ion trap having an interior region into which ions are admitted;

an RF trapping voltage source for applying an RF trapping voltage having a first amplitude to one or more of the plurality of electrodes to generate a field for trapping at least a portion of the ions admitted into the ion trap;

a resonance excitation voltage source for applying a resonance excitation voltage pulse for a pulse duration to cause at least a portion of a selected set of ions to undergo collisions and break into ion fragments; and the RF trapping voltage source being configured to reduce the RF trapping voltage after application of the resonance excitation voltage pulse to a second amplitude wherein the RF trapping voltage source is configured to reduce the RF trapping voltage sufficiently rapidly after initiation of application of the resonance excitation voltage pulse to retain a substantial portion of ion fragments, formed during application of the resonance excitation voltage pulse or within a delay period thereafter, having mass-to-charge ratios below the low-mass cut off at the first amplitude of the RF trapping voltage.

2. The apparatus of claim 1, wherein the stability parameter Q for the selected set of ions has a first value in the range of 0.4-0.89 when the RF trapping voltage has the first amplitude.

3. The apparatus of claim 1, wherein a second value of the stability parameter Q for the selected set of ions is in the range of 0.015-0.2 when the RF trapping voltage has the second amplitude.

4. The apparatus of claim 1, wherein the pulse duration is in the range of 0.25-1000 μsec.

5. The apparatus of claim 1, wherein the ion trap is a two-dimensional ion trap.

6. The apparatus of claim 1, further comprising an isolation waveform source for applying an isolation waveform to at least one electrode of the ion trap prior to application of the resonance excitation voltage to eliminate ions from the ion trap having mass-to-charge ratios lying outside of a mass-to-charge ratio of interest.

7. The apparatus of claim 1, wherein the resonance excitation voltage pulse is a direct current (DC) pulse.

8. The apparatus of claim 1, wherein the resonance excitation voltage pulse is an oscillatory voltage pulse composed of at least one frequency.

9. The apparatus of claim l, wherein the RF trapping voltage source is configured to reduce the RF trapping voltage after a delay time of between 1-1000 μs after termination of the resonance excitation voltage pulse.

10. A method of fragmenting ions in an ion trap of a mass spectrometer, comprising the steps of:

selecting for fragmentation a set of ions having a mass-to-charge ratio of interest;

applying an RF trapping voltage sufficient to bring the stability parameter Q of the selected set of ions to a first value;

applying a resonance excitation voltage pulse for a pulse duration to cause at least a portion of the set of ions to undergo collisions and break into ion fragments;

after application of the resonance excitation voltage pulse, reducing the RF trapping voltage to lower the Q of the selected set of ions to a second value less than the first value;

wherein the Q is lowered sufficiently rapidly after initiating application of the resonance excitation voltage pulse to retain a substantial portion of ion fragments, formed during application of the resonance excitation voltage pulse or within a delay period thereafter, having mass-to-charge ratios below the low-mass cut off at the first value of Q.

11. The method of claim 10, wherein the step of selecting the set of ions includes a step of expelling from the ion trap ions having mass-to-charge ratios outside of the mass-to-charge ratio of interest.

12. The method of claim 10, wherein the first value of Q is in the range of 0.4-0.89.

13. The method of claim 10, wherein the second value of Q is in the range of 0.015-0.2.

14. The method of claim 10, wherein the pulse duration is in the range of 0.25-500 μsec.

15. The method of claim 10 wherein the resonance excitation voltage pulse is a direct current (DC) pulse.

16. The method of claim 10, wherein the resonance excitation voltage pulse is an oscillatory voltage pulse composed of at least one frequency.

17. The method of claim 10, wherein the Q is lowered to the second value after a delay time of between 1-1000 μs after termination of the resonance excitation voltage pulse.

* * * * *